US007015649B2

(12) United States Patent
Masumura

(10) Patent No.: US 7,015,649 B2
(45) Date of Patent: Mar. 21, 2006

(54) APPARATUS AND METHOD FOR DRIVING CAPACITIVE LOAD, AND PROCESSING PROGRAM EMBODIED IN A RECORDING MEDIUM FOR DRIVING CAPACITIVE LOAD

(75) Inventor: Yuuki Masumura, Fukuroi (JP)

(73) Assignee: Pioneer Corporation, Tokyo (JP)

( * ) Notice: Subject to any disclaimer, the term of this patent is extended or adjusted under 35 U.S.C. 154(b) by 44 days.

(21) Appl. No.: 10/795,286

(22) Filed: Mar. 9, 2004

(65) Prior Publication Data

US 2004/0178741 A1 Sep. 16, 2004

(30) Foreign Application Priority Data

Mar. 11, 2003 (JP) ..... P2003-064524

(51) Int. Cl.
*G09G 3/10* (2006.01)
*G09G 3/28* (2006.01)

(52) U.S. Cl. ..... 315/169.4; 345/60

(58) Field of Classification Search ..... 327/111; 315/160, 167, 169.3, 169.4, 169.2, 169.1; 345/51, 55, 78, 60
See application file for complete search history.

(56) References Cited

U.S. PATENT DOCUMENTS 5,828,353 A * 10/1998 Kishi et al. ..... 345/55
6,011,355 A * 1/2000 Nagai ..... 315/169.3
6,567,059 B1 * 5/2003 Ide et al. ..... 345/60
6,675,301 B1 * 1/2004 Kurosawa ..... 713/300
6,762,567 B1 * 7/2004 Ide ..... 315/169.4
2002/0014853 A1 * 2/2002 Tokunaga et al. ..... 315/169.4
2002/0190928 A1 * 12/2002 Iwami et al. ..... 345/60
2003/0052659 A1 * 3/2003 Monomoushi et al. ..... 323/284
2003/0076638 A1 * 4/2003 Simonelli et al. ..... 361/56
2003/0169215 A1 * 9/2003 Iwami ..... 345/60
2003/0179017 A1 * 9/2003 Chen et al. ..... 327/78
2003/0214244 A1 * 11/2003 Onozawa et al. ..... 315/169.3
2004/0201546 A1 * 10/2004 Masumura et al. ..... 345/3.1
2004/0207333 A1 * 10/2004 Matsumoto ..... 315/169.4

FOREIGN PATENT DOCUMENTS

JP 02004309616 * 11/2004

* cited by examiner

*Primary Examiner*—Tuyet Vo
*Assistant Examiner*—Angela M Lie
(74) *Attorney, Agent, or Firm*—Sughrue Mion, PLLC

(57) ABSTRACT

A capacitive-load drive apparatus is provided with a first oscillation-transition-voltage-generation device which is connected between a first power supply and a capacitive load; a second oscillation-transition-voltage-generation device which is connected between a second power supply and the capacitive load; and a voltage-fluctuation-detection device which outputs a detection signal when the voltage of the first power supply or the second power supply fluctuates outside a specified range; and wherein the first oscillation-transition-voltage-generation device is provided with a first switch device and first inductance and moves the voltage of the capacitive load between a reference voltage and a first voltage by oscillation of the first inductance and the capacitive load; and the second oscillation-transition-voltage-generation device is provided with a second switch device and second inductance and moves the voltage of the capacitive load between the first voltage and a second voltage by oscillation of the second inductance and the capacitive load.

5 Claims, 5 Drawing Sheets

APPARATUS AND METHOD FOR DRIVING CAPACITIVE LOAD, AND PROCESSING PROGRAM EMBODIED IN A RECORDING MEDIUM FOR DRIVING CAPACITIVE LOAD

BACKGROUND OF THE INVENTION

1. Field of the Invention

This invention relates to a capacitive-load-drive apparatus that drives a capacitive load.

2. Description of the Related Art

In a drive apparatus that drives a plasma display panel, it is necessary to apply a high-voltage drive pulse to the plasma display panel, so a drive apparatus that is capable of obtaining a high output voltage is used. However, from the side of the drive apparatus, the plasma display panel becomes a capacitive load, so there is an inconvenience in that unneeded power is consumed when charging the capacitance.

SUMMARY OF THE INVENTION

Taking the above inconvenience into consideration, the object of this invention is to provide a capacitive-load-drive apparatus that is capable of driving a capacitive load with high efficiency.

The above object of the present invention can be achieved by a capacitive-load drive apparatus of the present invention. The apparatus is provided with: a first power supply; a second power supply; a first oscillation-transition-voltage-generation device which is connected between the first power supply and a capacitive load; a second oscillation-transition-voltage-generation device which is connected between the second power supply and the capacitive load; and a voltage-fluctuation-detection device which outputs a detection signal when the voltage of the first power supply or the second power supply fluctuates outside a specified range; and wherein the first oscillation-transition-voltage-generation device is provided with a first switch device and first inductance and moves the voltage of the capacitive load between a reference voltage and a first voltage by oscillation of the first inductance and the capacitive load; and the second oscillation-transition-voltage-generation device is provided with a second switch device and second inductance and moves the voltage of the capacitive load between the first voltage and a second voltage by oscillation of the second inductance and the capacitive load.

According to the present invention, a two-stage resonant circuit is used to obtain a high voltage in this way, so each coil in the resonant circuit stores up energy and functions as a discharge collection coil. Therefore, it is possible to obtain a highly efficient drive apparatus. Also, a voltage-fluctuation-detection device detects when the voltage between power supplies fluctuates outside a specified range, so it is possible to detect errors in the drive apparatus quickly and to execute proper control.

In one aspect of the present invention can be achieved by the capacitive-load drive apparatus of the present invention. The capacitive-load drive apparatus is, wherein the specified range is regulated by an upper limit and lower limit, and the voltage-fluctuation-detection device outputs a detection signal when the voltage of the first power supply or second power supply exceeds the upper limit or the lower limit.

According to the present invention, the voltage-fluctuation-detection device detects when the potentials of the midpoint-voltage-generation exceed the upper or lower limits in this way, so errors in operation can be detected quickly, and proper control can be executed. When the potential of a midpoint-voltage-generation point increases abnormally, or decreases abnormally, that abnormality is detected, however, it is also possible to detect just one of the two cases as being abnormal. Also, it is possible to select a midpoint-voltage-generation point for which detection will be performed. It is possible to detect fluctuations in the potential for either midpoint-voltage-generation point or both. When an error occurs in the operation of just one of the two stages of resonant circuits, it indicates an abnormal value for the potential at the midpoint-voltage-generation point of the other resonant circuit. Therefore, by detecting a voltage error at the midpoint-voltage-generation point of just one of the resonant circuits, it is possible to detect abnormal operation of the other resonant circuit.

In another aspect of the present invention can be achieved by the capacitive-load drive apparatus of the present invention. The capacitive-load drive apparatus is, wherein the first power supply or said second power supply is a capacity.

According to the present invention, it is easy to constitute the capacitive-load drive apparatus.

The above object of the present invention can be achieved by a method of driving capacitive-load of the present invention. The method of driving a capacitive-load is provided with: a first oscillation-transition-voltage-generation process of moving the voltage of a capacitive load between a reference voltage and a first voltage by oscillation of a first inductance and said capacitive load, which is performed between a first power supply and said capacitive load; a second oscillation-transition-voltage-generation process of moving the voltage of said capacitive load between said first voltage and a second voltage by oscillation of a second inductance and said capacitive load, which is performed between said second power supply and said capacitive load; and a voltage-fluctuation-detection process of outputting a detection signal when the voltage of said first power supply or said second-power supply fluctuates outside a specified range.

According to the present invention, a two-stage resonant circuit is used to obtain a high voltage in this way, so each coil in the resonant circuit stores up energy and functions as a discharge collection coil. Therefore, it is possible to obtain a highly efficient drive apparatus. Also, a voltage-fluctuation-detection device detects when the voltage between power supplies fluctuates outside a specified range, so it is possible to detect errors in the drive apparatus quickly and to execute proper control.

The above object of the present invention can be achieved by a driving a capacitive load program embodied in a recording medium which can be read by a computer in a capacitive loading apparatus of the present invention. The driving a capacitive load program embodied in a recording medium which can be read by a computer in a capacitive loading apparatus, the program making the computer function as: a first oscillation-transition-voltage-generation device which is connected between a first power supply and a capacitive load; a second oscillation-transition-voltage-generation device which is connected between a second power supply and said capacitive load; and a voltage-fluctuation-detection device which outputs a detection signal when the voltage of said first power supply or said second power supply fluctuates outside a specified range; and wherein said first oscillation-transition-voltage-generation device is provided with a first switch device and first inductance and moves the voltage of said capacitive load between a reference voltage and a first voltage by oscillation of said first inductance and said capacitive load; and said second oscillation-transition-voltage-generation device is provided with a second switch device and second inductance and moves the voltage of said capacitive load between said first voltage and a second voltage by oscillation of said second inductance and said capacitive load.

According to the present invention, a two-stage resonant circuit is used to obtain a high voltage in this way, so each coil in the resonant circuit stores up energy and functions as a discharge collection coil. Therefore, it is possible to obtain a highly efficient drive apparatus. Also, a voltage-fluctuation-detection device detects when the voltage between power supplies fluctuates outside a specified range, so it is possible to detect errors in the drive apparatus quickly and to execute proper control.

BRIEF DESCRIPTION OF THE DRAWINGS

FIG. 1A is a block diagram showing the construction of the plasma display panel drive apparatus of this embodiment, and FIG. 1B shows the construction of the plasma display panel;

DESCRIPTION OF THE PREFERRED EMBODIMENT

An embodiment of the plasma display panel drive apparatus of this invention will be explained below with reference to FIG. 1 to FIG. 6.

Figure 1A:
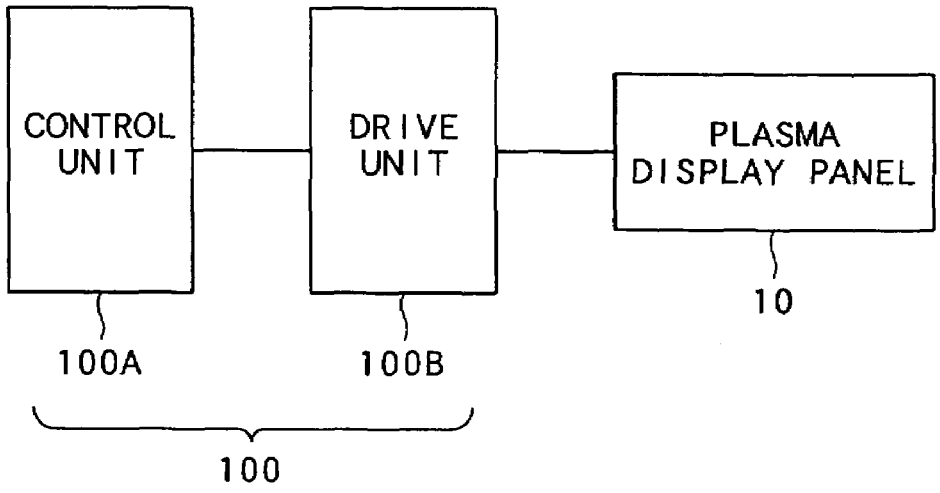
FIG. 1A and FIG. 1B are drawings showing the construction of a plasma display panel drive apparatus and plasma display panel of an embodiment of the invention, where
Figure 1B:
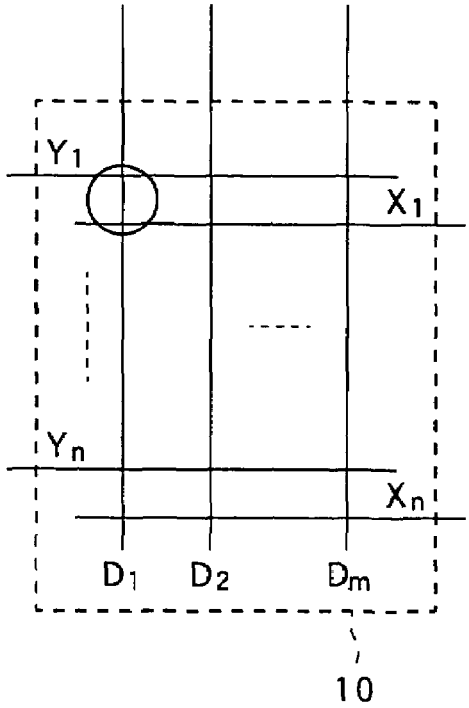

FIG. 1A is a block diagram showing the construction of the plasma display panel drive apparatus 100 of this embodiment, and FIG. 1B is a drawing showing the construction of the plasma display panel that is driven by the plasma display panel drive apparatus 100.

As shown in FIG. 1A, the plasma display panel drive apparatus 100 of this embodiment is provided with a control unit 100A for controlling the generation of a drive pulse, and a drive unit 100B that drives the plasma display panel 10 based on a control signal from the control unit 100A.

As shown in FIG. 1B, the plasma display panel 10 is provided with column electrodes D1 to Dm that run parallel with each other, and row electrodes X1 to Xn and row electrodes Y1 to Yn that run orthogonal to the column electrodes D1 to Dm. The row electrodes X1 to Xn and row electrodes Y1 to Yn are alternately placed, and a pair up of row electrode Xi ($1 \leqq i \leqq n$) and row electrode Yi ($1 \leqq i \leqq n$) make up an ith display line. The column electrodes D1 to Dm and row electrodes X1 to Xn and Y1 to Yn are each formed on two substrates that are attached such that they face each other and seal in discharge gas, and the intersections between column electrodes D1 to Dm and pairs of row electrodes X1 to Xn and row electrodes Y1 to Yn form discharge cells that are the picture elements of the display.

Figure 2:
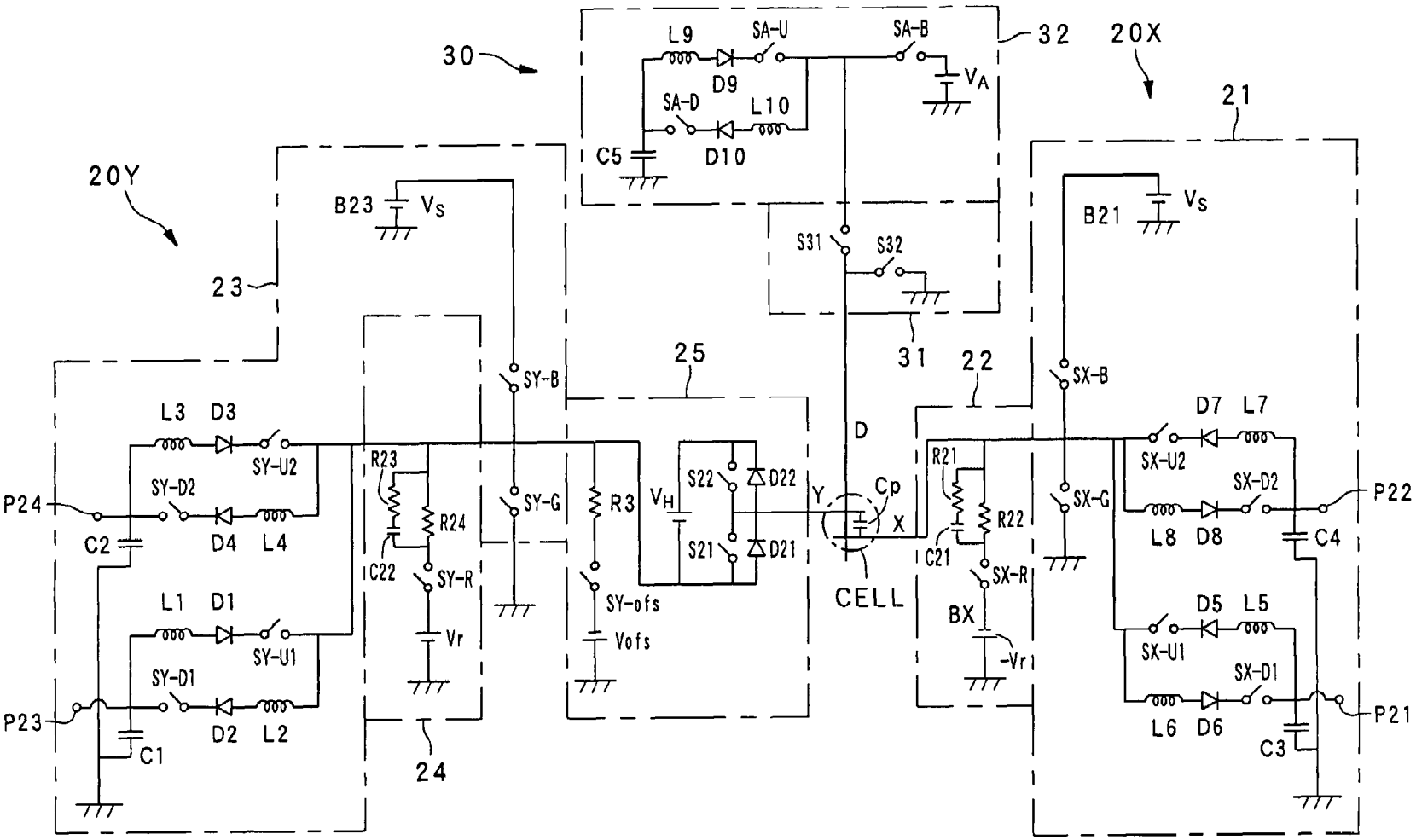
FIG. 2 is a circuit diagram of the circuitry of the control unit.

As shown in FIG. 2, the drive unit 10B of the plasma display panel drive apparatus 100 is provided with a row-electrode-drive unit 20X that drives the row electrodes X1 to Xn, a row-electrode-drive unit 20Y that drives the row electrodes Y1 to Yn, and column-electrode-drive unit 30 that drives the column electrodes D1 to Dm. In FIG. 2, the electrodes that form one discharge cell are shown as column electrode D, row electrode X and row electrode Y.

The row-electrode-drive unit 20X is provided with a sustain driver 21 that simultaneously applies an X sustain pulse to the row electrodes X1 to Xn of the plasma display panel 10, and a reset-pulse-generation circuit 22 that generates a reset pulse.

The sustain driver 21 is provided with: a capacitor C3, coil L5, diode D5, switch SX-U1, coil L6, diode D6 and switch SX-D1 that form a first-stage resonant circuit; and a capacitor C4, coil L7, diode D7, switch SX-U2, coil L8, diode D8 and switch SX-D2 that form a second-stage resonant circuit. Also, the sustain driver 21 is provided with: a switch SX-G for grounding the row electrode X, a power supply B21 for the voltage Vs, and a switch SX-B for setting the potential of the row electrode X to Vs.

The row-electrode-drive unit 20Y is provided with: a sustain driver that simultaneously applies a Y sustain pulse to the row electrodes Y1 to Yn of the plasma display panel 10, a reset-pulse-generation circuit 24 that generates a reset pulse, and a scan driver 25 that applies a scan pulse in order to the row electrodes Y1 to Yn.

The sustain driver 23 is provided with: a capacitor C1, coil L1, diode D1, switch SY-U1, coil L2, diode D2 and switch SY-D1 that form a first-stage resonant circuit; and a capacitor C2, coil L3, diode D3, switch SY-U2, coil L4, diode D4 and switch SY-D2 that form a second-stage resonant circuit. Also, the sustain driver 23 is provided with: a switch SY-G for grounding the row electrode Y, a power supply B23 for the voltage Vs, and a switch SY-B for setting the potential of the row electrode Y to Vs.

The column-electrode-drive unit 30 is provided with an address driver 31 that is connected to the column electrodes D1 to Dm, and an address-resonant-power-supply circuit 32 that supplies a drive pulse to the address driver 31.

Figure 3:
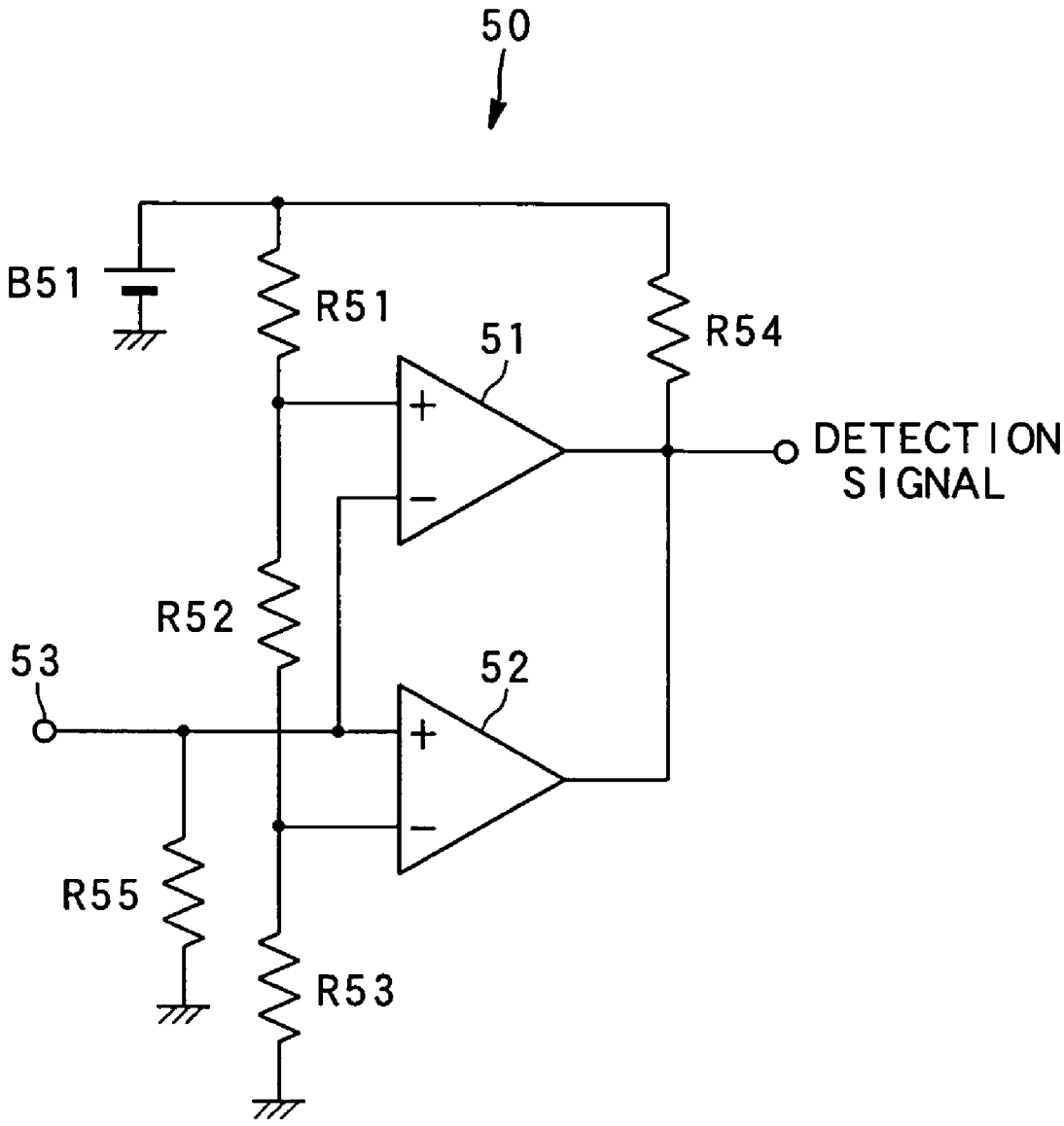
FIG. 3 is a circuit diagram showing the circuitry of the midpoint-voltage-detection unit for detecting the midpoint voltage.

FIG. 3 is a circuit diagram showing the circuit of the midpoint-voltage-detection unit for detecting the midpoint voltage of the sustain driver 21 and sustain driver 23. As shown in FIG. 3, the midpoint-voltage-detection unit 50 is provided with two op-amps 51 and 52, resistors R51 to R55 and a power supply 51. The input line 53 to the midpoint-voltage-detection unit 50 is connected to midpoint-voltage-generation points P21, P22 of the sustain driver 21, or to midpoint-voltage-generation points P23, P24 of the sustain driver 23. The input line 53 is connected to the negative input terminal of the op-amp 51 and positive input terminal of the op-amp 52. The operation of the midpoint-voltage-detection unit 50 will be described later.

Next, the operation of the plasma display panel drive apparatus 100 of this embodiment will be explained.

Figure 4:
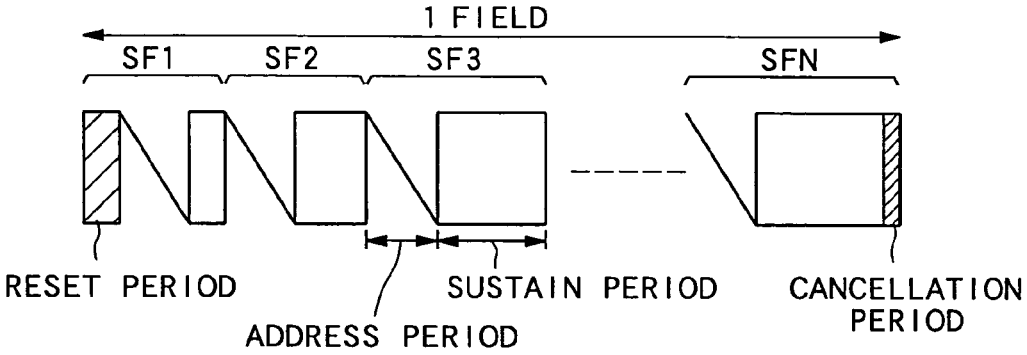
FIG. 4 is a drawing showing the construction of one field.

The field, which is the period that drives the plasma display panel, is made up of a plurality of sub-fields SF1 to SFN. As shown in FIG. 4, in each sub-field there is an address period that selects the discharge cells to be lit up, and a sustain period the keeps the cells selected in the address period lit up for a specified amount of time. Also, at the start of SF1, which is the first sub-field, there is a reset period for resetting the lit up state of the previous field. In this reset period, all of the cells are reset to be either light-emitting cells (cell having a wall charge) or to be non-emitting cells (cell not having a wall charge). In the former case, specified cells are switched to being non-emitting cells in the following address period, and in the latter case, specified cells are switched to being light-emitting cells in the following address period. The sustain period gradually becomes longer in the order of the sub-fields SF1 to SFN, and by changing the number of sub-fields that continue to be lit up, the specified gradation display is possible.

Figure 5:
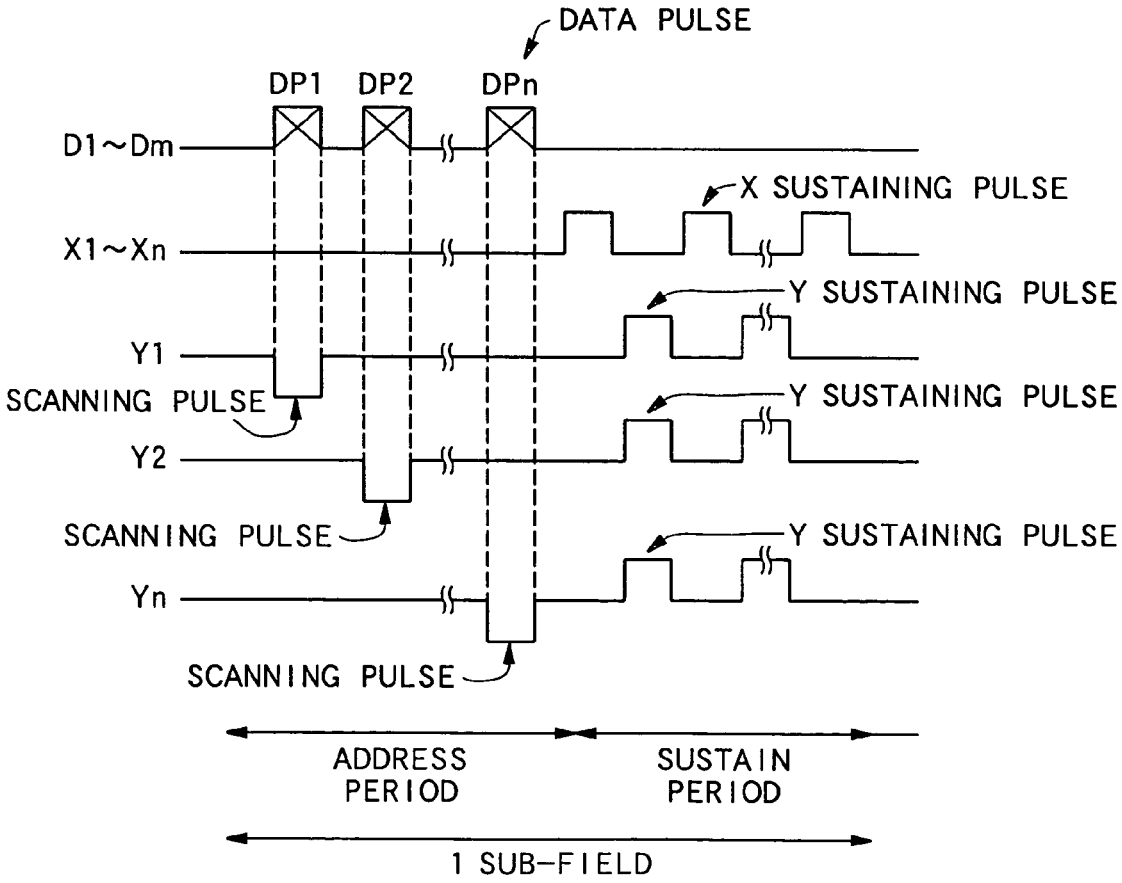
FIG. 5 is a drawing showing the drive pulse in one sub-field.

In the address periods of each of sub-fields shown in FIG. 5, address scanning is performed for each line. That is, at the same time that a scanning pulse is applied to the row electrode Y1 of the first line, a data pulse DP1 is applied to the column electrodes D1 to Dm according to the address data corresponding to the cells of the first line; then at the same time that a scanning pulse is applied to the row electrode Y2 of the second line, a data pulse DP2 is applied to the column electrodes D1 to Dm according to the address data corresponding to the cells of the second line. Similarly a scanning pulse and data pulse DP are applied simultaneously for the third line on as well. Finally, at the same time that a scanning pulse is applied to the row electrode Yn of the nth line, a data pulse DPn is applied to the column electrodes D1 to Dm according to the address data corresponding to the cells of the nth line. As described above, in the address period, specified cells are switched from being light-emitting cells to non-emitting cells, or are switched from being non-emitting cells are light-emitting cells.

After address scanning ends in this way, all of the cells in the sub-field are set respectively to being either light-emitting cells or non-emitting cells, and in the following sustain period, each time a sustain pulse is applied, only the light-emitting cells will repeatedly emit light. As shown in FIG. 5, in the sustain period, an X sustain pulse and Y sustain pulse are repeatedly applied at a specified timing to the row electrodes X1 to Xn and row electrodes Y1 to Yn, respectively. Also, in the last sub-field SFN, there is a cancellation period in which all of the cell are set to being non-emitting cells.

Figure 6:
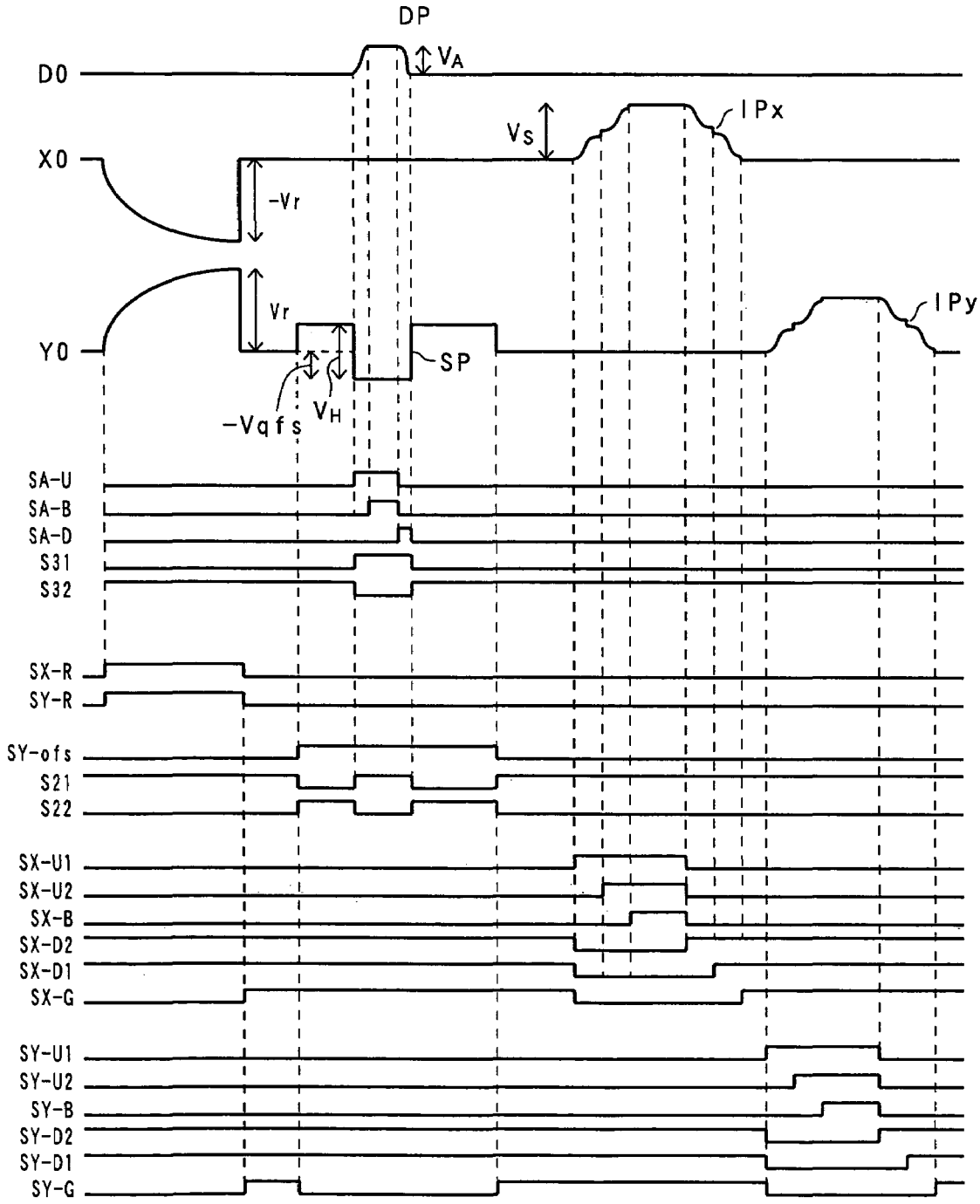
FIG. 6 is a timing chart showing the operation for generating a drive pulse.

Next, the operation when the plasma display panel drive apparatus 100 of this embodiment generates a drive pulse will be explained with reference to FIG. 6. FIG. 6 shows an example of resetting all of the discharge cells to light-emitting cells during the reset period.

In the plasma display panel drive apparatus 100, a drive pulse is generated by switching the switches in each unit of the drive unit 100B shown in FIG. 2 at a specified timing based on a signal from the control unit 100A. The control for switching each of the switches explained below is executed based on a control signal from the control unit 100A.

As shown in FIG. 6, in the reset period (see FIG. 4 and FIG. 5), the reset switch SX-R of the reset-pulse-generation circuit 22 and the reset switch SY-R of the reset-pulse-generation circuit 24 are switched ON simultaneously at a specified time.

By doing this, reset pulses having the form shown in FIG. 6 are applied to the row electrodes X1 to Xn and row electrodes Y1 to Yn, to form a wall charge in all of the discharge cells and reset all of the discharge cells to light-emitting cells.

As shown in FIG. 6, when reset switch SX-R and reset switch SY-R are switched OFF, switch SX-G of the sustain driver 21 and switch SY-G of the sustain driver 23 are switched ON, and the potentials of the row electrodes X1 to Xn and row electrodes Y1 to Yn are fixed to the ground potential (see FIG. 2).

In the reset period described above, wall charges are formed in each of the discharge cells, and these discharge cells are reset to light-emitting cells.

Next, in the address period (see FIG. 4 and FIG. 5), the switch SY-ofs of the scan driver 25 is switched ON, and connects the output line from the sustain driver 23 to the Vofs potential by way of the resistor R3. Also, switch 21 of the sustain driver 25 is switched in the order OFF-ON-OFF, and at the same time, the switch 22 of the sustain driver 25 is switched in the order ON-OFF-ON (see FIG. 2). In this way, the potential of row electrode Yi changes in the order [−Vofs+VH]−[−Vofs]−[−Vofs+VH] (see FIG. 6).

At the same time as this, by switching each of the switches of the address driver 31 and address-resonant-power-supply-circuit 32 in order, a data pulse is applied to the column electrodes D1 to Dm at the time that the potential of the row electrode Yi is lowered to [−Vofs].

More specifically, as shown in FIG. 6, by switching the switch S31 of the address driver 31 ON and the switching the switch S32 OFF while the data pulse DP is being output from the address-resonant-power-supply circuit 32, the output from the address-resonant-power-supply circuit 32 is connected to the column electrodes D1 to Dm.

Also, while the output from the address-resonant-power-supply circuit 32 is connected to the column electrodes D1 to Dm, the address-resonant-power-supply circuit 32 generates a data pulse DP. In other words, first the switch SA-U in the address-resonant-power-supply circuit 32 is switched ON. By doing this, current caused by the charge built up in the capacitor C5 flows to the column electrode D by way of the coil L9, diode D9, switch SA-U and switch 31, and gradually increases the voltage of the row electrode D. Next, by switching the switch SA-B ON, the voltage of the column electrode D is fixed to the voltage VA. Then, switch SA-U and switch SA-B are switched OFF, and at the same time switch SA-D is switched ON. By doing this, the current caused by the charge that is built up in the discharge cell flows to the capacitor C5 by way of the switch 31, coil L10, diode D10 and switch SA-D. Therefore, the potential of the column electrodes D gradually drops. Finally, at the same time that the switch SA-D is switched OFF, the switch S31 of the address driver 31 is switched OFF, and the switch S32 is switched ON. In this way, the column electrode D is cut off from the address-resonant-power-supply circuit 32, and the potential of the column electrode D is fixed at 0V.

Next, in the sustain period (see FIG. 4 and FIG. 5), and the sustain driver 21 and sustain driver 23 generate an X sustain pulse and Y sustain pulse, respectively.

As shown in FIG. 6, in the sustain driver 21, the switch SX-U1 is switched ON, and switch SX-D1, switch SX-D2 and switch SX-G are switched OFF. As a result, only switch SX-U1 is switched ON. Therefore, by oscillating based on the inductance of coil L5 and the capacity of the capacitance Cp between row electrodes of the discharge cell, current caused by the charge built up in the capacitor C3 flows to the capacitance Cp between row electrodes by way of the coil L5, diode D5, switch SX-U1 and row electrode X, so the potential of the row electrode X increases to approximately ½ Vs.

Next, when the switch SX-U2 is switched ON, by oscillating based on the inductance of the coil L7 and the capacity of the capacitance Cp between row electrodes of the discharge cell, current caused by the charge built up in the capacitor C4 flows to the capacitance Cp between row electrodes by way of the coil L7, diode D7 and switch SX-U2, so the potential of the row electrode X increases to approximately Vs. Next, by switching ON switch SX-B, the potential of the row electrode X is fixed at Vs.

Next, switch SX-Ul, switch SX-U2 and switch SX-B are switched OFF and switch SX-D2 is switched ON. As a result, only switch SX-D2 is switched ON. Therefore, by oscillating based on the inductance of the coil L8 and the capacity of the capacitance Cp between row electrodes of the discharge cell, current caused by the charge built up in the capacitance Cp between row electrodes flows to the capacitor C4 by way of the row electrode X, coil L8, diode D8 and switch SX-D2, so the potential of the row electrode X drops to approximately ½ Vs.

Next, when the switch SX-D1 is switched ON, by oscillating based on the inductance of the coil L6 and the capacity of the capacitance Cp between row electrodes of the discharge cell, current caused by the charge described above flows to the capacitor C3 by way of the row electrode X, coil L6, diode D6 and switch SX-D1, so the potential of the row electrode X drops to near 0 V. Finally, by switching the switch SX-G ON, the potential of the row electrode X is fixed at 0 V.

After the potential of the row electrode X is fixed at 0 V, in the sustain driver 23, the switch SY-U1 is switched ON, and switch SY-D1, switch SY-D2 and switch SY-G are switched OFF. As a result, only switch SY-U1 is switched ON. Therefore, by oscillating based on the inductance of coil L1 and the capacity of the capacitance Cp between row electrodes of the discharge cell, current caused by the charge built up in the capacitor C1 flows to the capacitance Cp between row electrodes by way of the coil L1, diode D1, switch SY-U1 and row electrode Y, so the potential of the row electrode Y increases to approximately ½ Vs.

Next, when the switch SY-U2 is switched ON, by oscillating based on the inductance of the coil L3 and the capacity of the capacitance Cp between row electrodes of the discharge cell, current caused by the charge built up in the capacitor C2 flows to the capacitance Cp between row electrodes by way of the coil L3, diode D3 and switch SY-U2, so the potential of the row electrode Y increases to approximately Vs. Next, by switching ON switch SY-B, the potential of the row electrode Y is fixed at Vs.

Next, switch SY-U1, switch SY-U2 and switch SY-B are switched OFF and switch SY-D2 is switched ON. As a result, only switch SY-D2 is switched ON. Therefore, by oscillating based on the inductance of the coil L4 and the capacity of the capacitance Cp between row electrodes of the discharge cell, current caused by the charge built up in the capacitance Cp between row electrodes flows to the capacitor C2 by way of the row electrode Y, coil L4, diode D4 and switch SY-D2, so the potential of the row electrode Y drops to approximately ½ Vs.

Next, when the switch SY-D1 is switched ON, current caused by the charge described above flows to the capacitor C1 by way of the row electrode Y, coil L2, diode D2 and switch SY-D1, so the potential of the row electrode Y drops to near 0 V. Finally, by switching the switch SY-G ON, the potential of the row electrode Y is fixed at 0 V.

By repeating the operation above, X sustain pulses and Y sustain pulse having a waveform as shown in FIG. 6 are alternately generated, and cause the discharge cell selected in the address period to light up a specified number of times.

In this way, in this embodiment, oscillation of the coil and capacitance between row electrodes is used to obtain a specified drive voltage, and each coil stores energy and functions as a discharge collection coil. Therefore, it is possible obtain an efficient drive apparatus having low power consumption. Also, by using resonant circuits in two stages, it is possible to obtain sustain pulses having a waveform that gently changes as shown in FIG. 6.

Next, the operation of the midpoint-voltage-detection unit 50 will be explained.

When the sustain driver 21 is operating properly according to the operation timing shown in FIG. 6, the potential at the midpoint-voltage-generation point P21 is approximately ¼ Vs, and the potential at the midpoint-voltage-generation point P22 is approximately ¾ Vs. Also, similarly, when the sustain driver 23 is operating properly, the potential at the midpoint-voltage-generation point P23 is approximately ¼ Vs, and the potential at the midpoint-voltage-generation point P24 is approximately ¾ Vs. The potential at the midpoint-voltage-generation point P21 corresponds to the voltage between both ends of the capacitor C3, the potential at the midpoint-voltage-generation point P22 corresponds to the voltage between both ends of the capacitor C4, the potential at the midpoint-voltage-generation point P23 corresponds to the voltage between both ends of the capacitor C1 and the potential at the midpoint-voltage-generation point P24 corresponds to the voltage between both ends of the capacitor C2.

However, when the operation timing is off due to an error in the control signal that is supplied to the sustain driver 21, or when there is some problem with the sustain driver 21, a shift occurs in the potential at the midpoint-voltage-generation point P21 or midpoint-voltage-generation point P22. Also, when the operation timing is off due to an error in the control signal that is supplied to the sustain driver 23, or when there is some problem with the sustain driver 23, a shift occurs in the potential at the midpoint-voltage-generation point P23 or midpoint-voltage-generation point P24.

The midpoint-voltage-detection unit 50 detects this kind of fluctuation in the potential at the midpoint-voltage-generation points P21 to P24, and outputs a detection signal.

For example, when the input line of the midpoint-voltage-detection unit 50 is connected to midpoint-voltage-generation point P21, by properly selecting values for resistors R51 to R53, which function as a voltage-dividing resistance for dividing the voltage of the power supply B51, the positive-input terminal of the op-amp 51 is set to the upper-limit potential and the negative-input terminal of the op-amp is set to the lower-limit potential (see FIG. 3).

Since the input line 53 is connected to the negative-input terminal of op-amp 51 and the positive-input terminal of the op-amp 52, when the potential of the input line 53, or in other words, the potential at the midpoint-voltage-generation point P21, becomes greater than the upper-limit potential, the output potential of the op-amp 51 becomes negative and a negative potential detection signal is output. Also, when the potential of the input line 53, or in other words, the potential at the midpoint-voltage-generation point P21, becomes less than the lower-limit potential, the output potential of the op-amp 52 becomes negative, and a negative potential detection signal is output. When the potential at the midpoint-voltage-generation point P21 is between the lower limit and upper limit, or in other words, when it is normal, the output of the op-amp 51 and op-amp 52 becomes open and the detection signals is a positive potential.

Therefore, when the potential at the midpoint-voltage-generation point P21 exceeds the preset upper or lower limit, a detection signal (negative signal) is output. In this embodiment, the detection signal (negative signal) is sent to the control unit 100A, so that the control unit 100A stops outputting a control signal to the drive unit 100B. Therefore, when the potential at the midpoint-voltage-generation point is abnormal, it is possible to stop the operation of the drive unit 100B. By doing this, it is possible to avoid problems such as when the resonant circuit of only one stage of the two stages of resonant circuits operates.

When the potential at the midpoint-voltage-generation point P22 of the sustain driver 21, or the potentials at the midpoint-voltage-generation points P23, P24 of the sustain driver 23 are abnormal as well, detection is possible by the same method. In this case, it is possible to properly set the upper and lower limits for the potentials at each midpoint-voltage-generation point by selecting values for the resistors R51 to R53.

In this embodiment, the midpoint-voltage-detection unit 50 detects when the potentials of the midpoint-voltage-generation points P21 to P24 exceed the upper or lower limits in this way, so errors in operation can be detected quickly, and proper control can be executed. In this embodiment, when the potential of a midpoint-voltage-generation point increases abnormally, or decreases abnormally, that abnormality is detected, however, it is also possible to detect just one of the two cases as being abnormal. Also, it is possible to select a midpoint-voltage-generation point for which detection will be performed. For example, in order to detect errors in the sustain driver 21, it is possible to detect fluctuations in the potential for either midpoint-voltage-generation point P21 or P22, or both. When an error occurs in the operation of just one of the two stages of resonant circuits, it indicates an abnormal value for the potential at the midpoint-voltage-generation point of the other resonant circuit. Therefore, by detecting a voltage error at the midpoint-voltage-generation point of just one of the resonant circuits, it is possible to detect abnormal operation of the other resonant circuit.

As was explained above, the capacitive-load-drive apparatus of this invention is provided with: a first-stage resonant circuit that is located between the capacitor C3 and capacitance between row electrodes Cp and that has a coil L5, switch SX-U1, coil L6 and switch SX-D1; a second-stage resonant circuit that is located between the capacitor C4 and capacitance between row electrodes Cp and that has a coil L7, switch SX-U2, coil L8 and switch SX-D2; and a midpoint-voltage-detection unit 50 that outputs a detection signal when the voltage between the ends of the capacitor C3 fluctuates outside a specified range; and it moves the potential of the row electrode X between 0 V and ½ Vs by oscillation of the coil L5 and capacitance between row electrodes Cp, or by oscillation of the coil L6 and the capacitance between row electrodes Cp, and moves the potential of the row electrode X between ½ Vs and 0 V by oscillation of the coil L7 and capacitance between row electrodes Cp, or by oscillation of the coil L8 and the capacitance between row electrodes Cp.

In this embodiment, a two-stage resonant circuit is used to obtain a high voltage in this way, so each coil in the resonant circuit stores up energy and functions as a discharge collection coil. Therefore, it is possible to obtain a highly efficient drive apparatus. Also, in this embodiment, a midpoint-voltage-detection unit 50 detects when the voltage between the ends of the capacitor C3 fluctuates outside a specified range, so it is possible to detect errors in the drive apparatus quickly and to execute proper control.

In the embodiment and scope of the invention described above, capacitor C3 and capacitor C1 correspond to a 'first power supply'; capacitor C4 and capacitor C2 correspond to a 'second power supply'; the midpoint-voltage-detection unit 50 corresponds to a 'voltage-fluctuation-detection means'; switch SX-U1, switch SX-D1, switch SY-U1 and switch SY-D1 correspond to a 'first switch means'; coil L5, coil L6, coil L1 and coil L2 correspond to a 'first inductance'; switch SX-U2, switch SX-D2, switch SY-U2 and switch SY-D2 correspond to a 'second switch means'; coil L7, coil L8, coil L3 and coil L4 correspond to a 'second inductance'; and capacitors C1 to C4 correspond to a 'capacity'.

In the embodiment above, an example of a drive apparatus that drives a plasma display panel was given, however the drive apparatus of this invention is not limited to a drive apparatus that drives a plasma display panel or any other kind of display panel, and can be widely applied to drive apparatuses that drive a capacitive load.

It should be understood that various alternatives to the embodiment of the invention described herein may be employed in practicing the invention. Thus, it is intended that the following claims define the scope of the invention and that methods and structures within the scope of these claims and their equivalents be covered thereby.

The entire disclosure of Japanese Patent Application No. 2003-64524 filed on Mar. 11, 2003 including the specification, claims, drawings and summary are incorporated herein by reference in its entirety.

What is claimed is:

1. A capacitive-load drive apparatus comprising:

a first power supply;

a second power supply;

a first oscillation-transition-voltage-generation device which is connected between said first power supply and a capacitive load;

a second oscillation-transition-voltage-generation device which is connected between said second power supply and said capacitive load; and a voltage-fluctuation-detection device which outputs a detection signal when said first power supply voltage or said second power supply voltage fluctuates outside a specified range;

wherein said first oscillation-transition-voltage-generation device comprises a first switch device and a first inductance and moves a voltage of said capacitive load between a reference voltage and a first voltage by oscillation of said first inductance and said capacitive load;

wherein said second oscillation-transition-voltage-generation device comprises a second switch device and a second inductance and moves the voltage of said capacitive load between said first voltage and a second voltage by oscillation of said second inductance and said capacitive load; and wherein said first voltage is larger than said reference voltage, and said second voltage is larger than said first voltage.

2. The capacitive-load-drive apparatus according to claim 1, wherein said specified range is regulated by an upper limit and lower limit, and said voltage-fluctuation-detection device outputs a detection signal when the voltage of said first power supply or second power supply exceeds said upper limit or said lower limit.

3. The capacitive-load-drive apparatus according to claim 1, wherein said voltage of said first power supply or said second power supply is a charged capacitor.

4. A method of driving a capacitive-load comprising:

a first oscillation-transition-voltage-generation process of moving a voltage of a capacitive load between a reference voltage and a first voltage by oscillation of a first inductance and said capacitive load, which is performed between a first power supply and said capacitive load;

a second oscillation-transition-voltage-generation process of moving the voltage of said capacitive load between said first voltage and a second voltage by oscillation of a second inductance and said capacitive load, which is performed between said second power supply and said capacitive load, wherein said first voltage is larger than said reference voltage, and said second voltage is larger than said first voltage; and a voltage-fluctuation-detection process of outputting a detection signal when a voltage of said first power supply or a voltage of said second power supply fluctuates outside a specified range.

5. A driving a capacitive load program embodied in a recording medium which is read by a computer in a capacitive loading apparatus, the program making the computer function as:

a first oscillation-transition-voltage-generation device which is connected between a first power supply and a capacitive load;

a second oscillation-transition-voltage-generation device which is connected between a second power supply and said capacitive load; and a voltage-fluctuation-detection device which outputs a detection signal when the voltage of said first power supply or said second power supply fluctuates outside a specified range; and wherein said first oscillation-transition-voltage-generation device comprises a first switch device and a first inductance and moves a voltage of said capacitive load between a reference voltage and a first voltage by oscillation of said first inductance and said capacitive load;

said second oscillation-transition-voltage-generation device comprises a second switch device and second inductance and moves the voltage of said capacitive load between said first voltage and a second voltage by oscillation of said second inductance and said capacitive load; and wherein said first voltage is larger than said reference voltage, and said second voltage is larger than said first voltage.

* * * * *